US005611804A

United States Patent [19]

Heintke et al.

[11] Patent Number: 5,611,804

[45] Date of Patent: Mar. 18, 1997

[54] APPLIANCE FOR THE REMOVAL OF BODY HAIRS

[75] Inventors: Hans-Eberhard Heintke, Wächtersbach; Achim Flesser, Königstein, both of Germany

[73] Assignee: Braun Aktiengesellschaft, Kronberg, Germany

[21] Appl. No.: 257,684

[22] Filed: Jun. 9, 1994

[30] Foreign Application Priority Data

Jun. 24, 1993 [DE] Germany ..... 43 20 958.0

[51] Int. Cl.[6] ..... A45D 26/00; A45D 27/00

[52] U.S. Cl. ..... 606/133; 30/34.05

[58] Field of Search ..... 606/133, 131; 30/34.05, 90, 45, 43.92, 43.91

[56] References Cited

U.S. PATENT DOCUMENTS

| | | | |
|---|---|---|---|
| 2,598,292 | 5/1952 | O'Russa | 30/34.05 X |
| 3,104,662 | 9/1963 | Morawetz . | |
| 3,672,049 | 6/1972 | Demci et al. . | |
| 4,830,004 | 5/1989 | Alazet . | |
| 4,960,422 | 10/1990 | Demeester . | |
| 5,032,126 | 7/1991 | Cleyet et al. . | |
| 5,041,123 | 8/1991 | Oliveau et al. . | |
| 5,084,055 | 1/1992 | Demeester . | |
| 5,190,559 | 3/1993 | Gabion et al. . | |
| 5,234,441 | 8/1993 | Heintke et al. . | |

FOREIGN PATENT DOCUMENTS

| | | | |
|---|---|---|---|
| 0328426 | 8/1989 | European Pat. Off. . | |
| 710537 | 8/1931 | France . | |
| 1223554 | 6/1960 | France . | |
| 2588732 | 10/1985 | France . | |
| 268435 | 12/1913 | Germany . | |
| 2001858 | 1/1970 | Germany . | |
| 4348704 | 12/1992 | Japan | 606/133 |

OTHER PUBLICATIONS

Thiele, "Thiele Handlexikon der Medizin", Verlag Urban und Schwarzenberg, Bd. 1, S. 488, 654 und 668.

Band, "Der Grosse Brockhaus", Verlag F.A. Brockhous, Wiesbaden, 18. Aufl. (1978) Dritter Band, S. 68, 469 und 490.

*Primary Examiner*—Mickey Yu

*Attorney, Agent, or Firm*—Fish & Richardson, P.C.

[57] ABSTRACT

The invention is directed to an appliance for the removal of body hairs which is adapted to receive a first attachment incorporating an epilating cylinder or, alternatively, a second attachment incorporating a long-hair trimmer. The attachment incorporating the long-hair trimmer includes a blade or an outer cutter adapted to be driven by a gear arrangement and executing a reciprocating motion in alternate directions relative to a comb or an inner cutter.

15 Claims, 3 Drawing Sheets

APPLIANCE FOR THE REMOVAL OF BODY HAIRS

FIELD OF THE INVENTION

This invention relates to an appliance for the removal of human body hairs, with a driving gear carried in a casing and adapted to be driven by a motor, as well as with an epilating cylinder mounted in an epilation head and adapted to be rotated by the driving gear for gripping and extracting the body hairs.

BACKGROUND OF THE INVENTION

Epilating appliances of this or a similar type are known, for example, from the prior publications US 4 575 902 A, US 4 960 422 A or US 5 084 055 A, which are included in the disclosure content of the present application by express reference thereto. Two types of hair removal must be distinguished, namely the removal of hairs on the skin surface (depilation) and the removal of hairs by the roots (epilation). Motor-powered epilating appliances operate on the principle of gripping and clamping the hairs to be removed and extracting them from the skin by the roots by means of pincerlike clamping members opening and closing at periodic intervals. Extraction is accomplished by the pincerlike clamping members being moved rapidly away from the skin after gripping the hair or hairs. This movement of the clamping members away from the skin may be accomplished, for example, in that the clamping members are part of a rotary cylinder, being periodically moved towards and away from each other as the cylinder rotates.

It is a general problem in appliances of the type initially referred to to increase the efficiency while reducing the sensation of pain experienced by the user during hair removal.

SUMMARY OF THE INVENTION

According to the present invention, this object is essentially accomplished in that in an appliance of the above-mentioned type the epilation head is configured as a first attachment that attaches to, and detaches from, the casing, and that the appliance is operatively associated with a second attachment attachable to the casing in exchange for the first attachment, which second attachment includes means for depilating the body hairs.

Considering that the first and the second attachment are mountable on the casing in an interchangeable fashion, the appliance is suitable for both epilation and depilation, enabling it to be utilized as a "combination appliance", so to speak. The first attachment is provided with the epilating cylinder by means of which body hairs can be gripped and extracted. Thus, the first attachment is suitable for utilization as an epilating appliance in a known manner. However, in contrast thereto, when the second attachment is mounted on the casing, another function, namely a depilation of body hairs can be performed. It will thus be seen that the second attachment generally serves the function of pretreating the body hairs before the epilation process proper. This prior treatment enables the epilating cylinder to remove the body hairs more effectively, in addition to be suitable for reducing the user's sensation of pain. The present invention thus provides an appliance for the removal of body hairs in which exchangeable attachments performing different functions make it possible to improve the quality of hair removal.

In an advantageous further feature of the present invention, the second attachment is provided with a long-hair trimmer for cutting the body hairs. The long-hair trimmer is suitable for pre-treating the body hairs in such a manner that the user cuts off the body hairs on the skin surface in a first step, a subsequent second step which may follow after a certain, individually varying period of time then involving the extraction of the body hairs meanwhile grown back to approximately equal lengths or having a common upper length, using the epilation head attached to the appliance. Owing to the approximately equal lengths of the body hairs, the epilating cylinder is in a position to securely grip and extract the hairs since their engagement within the plucking members of the epilating cylinder is improved. Overall, pre-treating the body hairs by means of the long-hair trimmer enables the body hairs to be plucked out by the epilating cylinder more reliably, in addition to diminishing the number of futile plucking operations (gripping the hairs without plucking them), resulting in a reduced sensation of pain.

In an embodiment of the present invention which has proved to be suitable in practice, the time interval between successive uses of, first, the second attachment incorporating the long-hair trimmer for trimming the body hairs and then the first attachment incorporating the epilating cylinder for gripping and plucking the body hairs, is between 3 to 12 days, approximately, in particular about one week. The time interval depends on the rate at which the individual user's hair grow back. This time lag mitigates the sensation of pain during epilation. This phenomenon may be explained as follows: Body hairs grow very rapidly in a first growth cycle, the growth slowing down in a subsequent second cycle until a standstill is reached (third cycle). Finally, the hairs fall out in a last, fourth cycle. When the body hairs are depilated a certain time before being epilated, the body hairs in the third cycle do not grow back, while the body hairs in the fourth cycle fall out by themselves. Hairs which have attained this growth cycle need not be epilated any longer, which means that these hairs will neither be gripped nor plucked out by the epilating cylinder. Due to prior depilation, the number of hairs to be epilated is reduced, which adds significantly to further mitigating the pain sensed by the user during epilation.

In an advantageous further aspect of the present invention, the long-hair trimmer includes a blade or an outer cutter adapted to be driven by a gear arrangement and performing an oscillating motion relative to a comb or an inner cutter. Advantageously, the gear arrangement is configured such that the oscillating frequency of the blade is about three to seven times, in particular five times, the rotational frequency of the epilating cylinder. In practice, the epilating cylinder is rotated at about 1,200 to 1,400 rpm, and the blade at about 6,000 rpm. The gear arrangement is advantageously configured as an angular gear arrangement converting the rotary motion of the driving gear into an alternating motion of the blade. The gear arrangement includes a crown gear adapted to be driven by the driving gear and meshing with a pinion provided with an eccentrically arranged engaging means coupled to the blade. In this manner, a small number of simple and thus low-cost components provide a long-hair trimmer attachable to the appliance in exchange for the epilation head.

Further features, advantages and application possibilities of the present invention will become apparent from the subsequent description of embodiments illustrated in more detail in the accompanying drawings. It will be understood that all features described and/or represented by illustration, whether taken alone or in any desired combination, constitute the subject-matter of the present invention, irrespective of their summarization in the claims and their back-references.

DESCRIPTION OF THE PREFERRED EMBODIMENT

Figure 1:
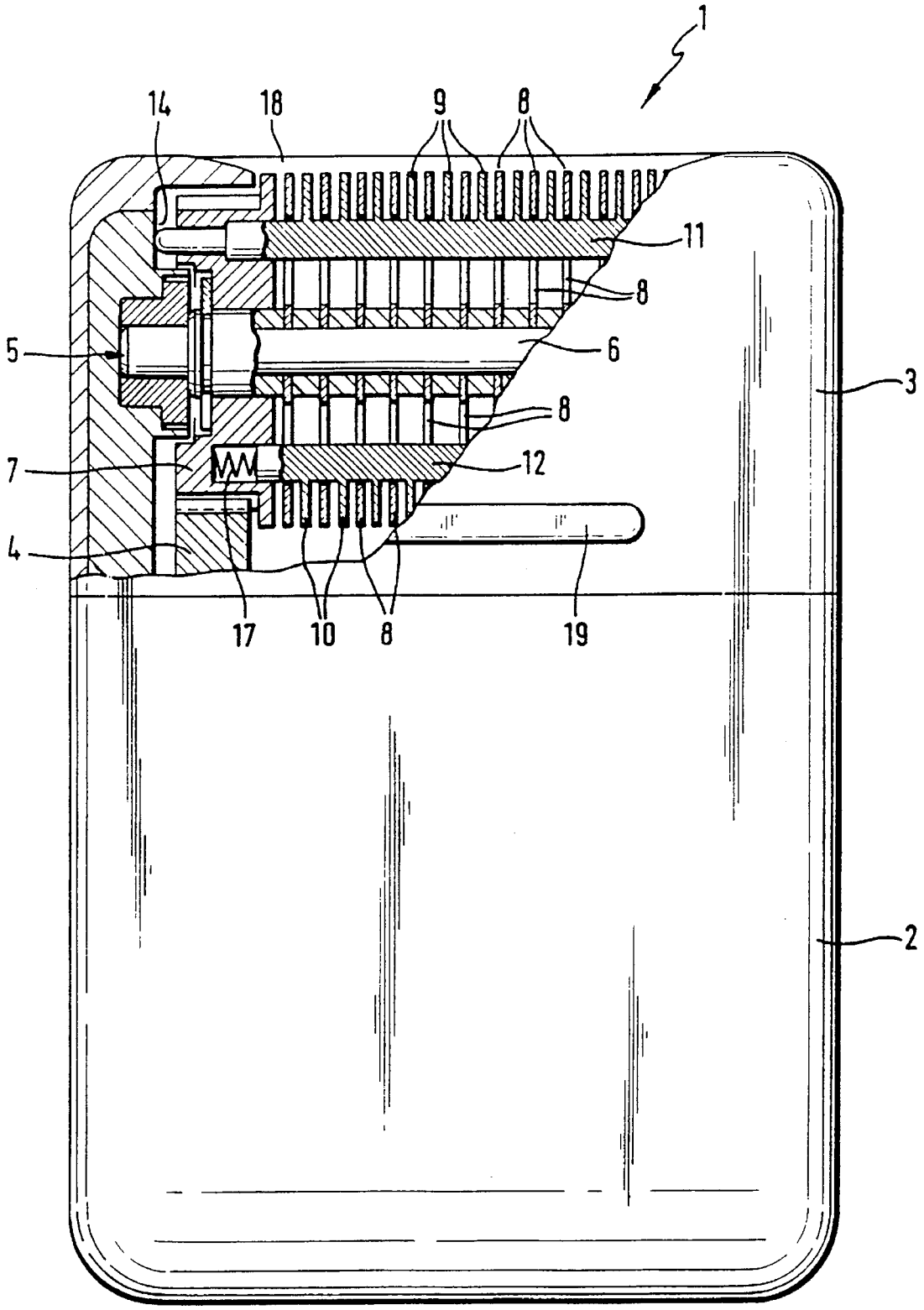
FIG. 1 is a schematic side view partly in section and showing an appliance for the removal of human body hairs according to an embodiment of the present invention.

The appliance 1 for the removal of human body hair as illustrated in FIG. 1 is composed of a casing 2 and a first attachment 3. The casing 2 accommodates a motor, preferably an electric motor, which is coupled to a driving gear 4 rotary within the casing 2 either directly or through the intermediary of a gear arrangement, the motor rotating the gear when in turned-on condition.

The first attachment 3 configured as an epilation head comprises an epilating cylinder 5 which is coupled to the driving gear 4 and, with the motor turned on, rotates about its longitudinal axis or also oscillates. As will be explained in the following, the rotary epilating cylinder 5 serves to grip and extract body hairs.

Figure 2:
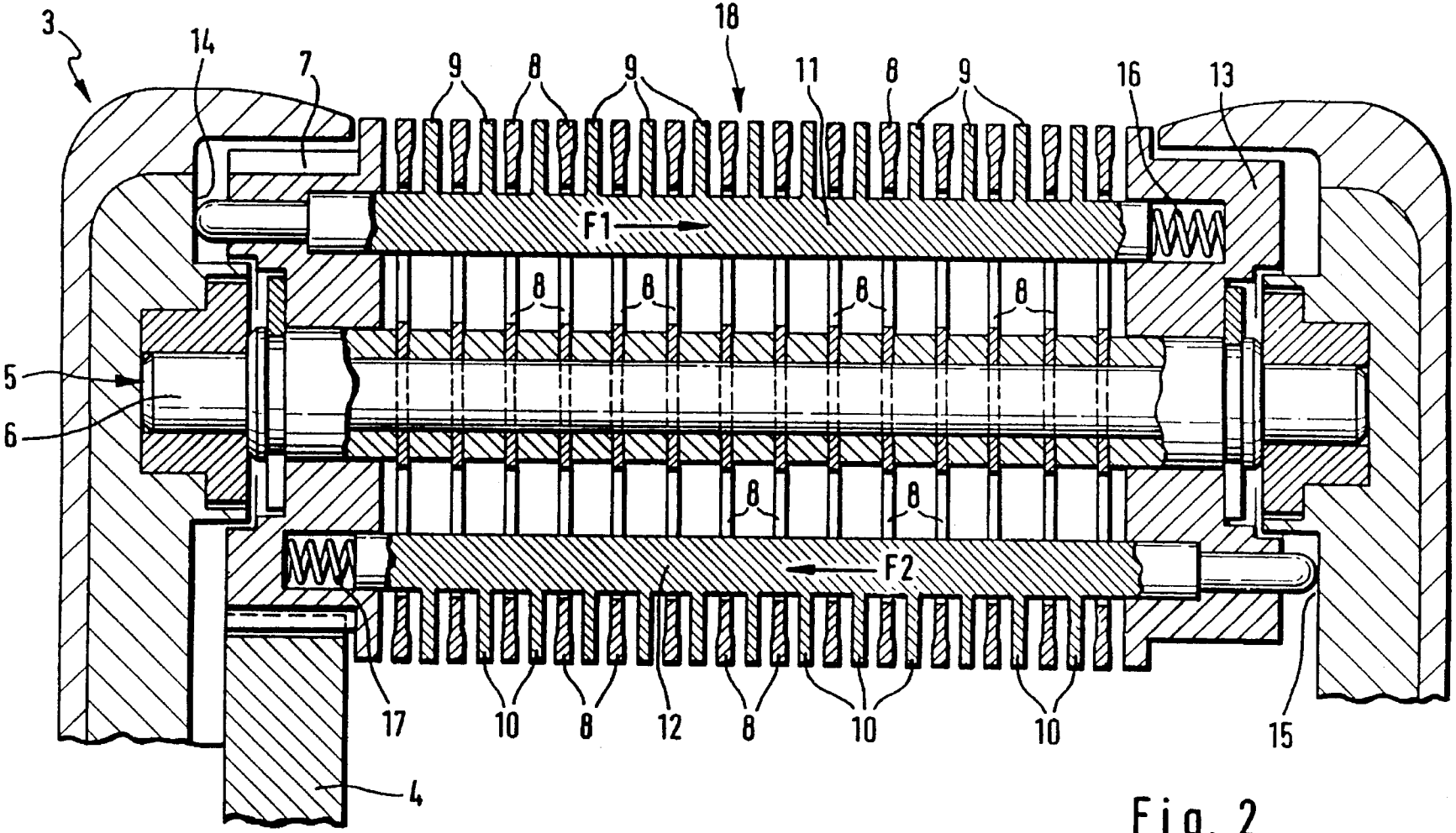
FIG. 2 is a schematic sectional view of a first attachment incorporating an epilating cylinder for the appliance of FIG. 1.

In FIG. 2, the first attachment 3 incorporating the epilating cylinder 5 is illustrated in greater detail. The epilating cylinder 5 includes a shaft 6 rotatably mounted in the first attachment 3. A gear 7 mounted on the shaft 6 in a non-rotatable relationship thereto provides for coupling of the shaft to the driving gear 4. The shaft 6 carries a series of disks 8 extending approximately radially outwardly from the shaft 6. Inserted between the disks 8 are clamping members 9, 10 extending likewise approximately radially outwardly from the shaft 6. One of the clamping members 9, 10 is arranged between two adjacent disks each. According to the embodiment of FIG. 2, the clamping members 9 are provided above the shaft 6, while the clamping members 10 are provided below the shaft 6, the clamping members 9 and 10 being accordingly in diametrically opposite arrangement. While the clamping members 9 are mounted on an actuating rod 11, the clamping members 10 are mounted on an actuating rod 12. The disks 8 have passages through which the actuating rods 11, 12 extend. The actuating rods 11, 12 have their one end slidably guided in the gear 7 and their other end in a flange 13, partaking of a rotary movement of the epilating cylinder 5. With their free ends, the actuating rods 11 and 12 rest against a guideway 14 and 15, respectively. At the ends of the actuating rods 11, 12 remote from the guideways 14, 15, springs 16 and 17, respectively, are provided, urging the actuating rods 11, 12 against the guideways 14, 15. The guideways 14, 15 are provided with cams protruding in the direction of the disks 8 and the clamping members 9, 10. The cams are arranged such as to cause displacement of the actuating rods 11, 12 whenever the related clamping members 9, 10 are above the hairs to be removed, in FIG. 2 accordingly in the area of an opening 18 of the first attachment 3.

With the shaft 6 rotating, the cams of the guideways 14, 15 displace the actuating rods 11, 12 against the springs 16, 17, in the direction of arrows F1 and F2 when viewing FIG. 2. This also results in a displacement of the related clamping members 9, 10 in the same direction and their coming in contact with the adjacent disks 8. Body hairs which have previously engaged between the clamping members 9, 10 and the disks 8 are thus clamped in a pincerlike fashion. On further rotation of the shaft 6 and thus of the clamping members 9, 10 and the disks 8, the firmly gripped body hairs are plucked out of the skin. With the rotation of the shaft 6 continuing, the actuating rods 11, 12 arrive at the end of the cams, causing the springs 16, 17 to urge the clamping members 9, 10 back into the position illustrated in FIG. 2 in which the plucked-out hairs are released.

The first attachment 3 and the casing 2 are conformed to each other in their structure, in particular their outer shape. Further, the first attachment 3 and the casing 2 are provided with means enabling them to be connected together and pulled apart again. Such means may be of the locking or clamping type provided with actuating means for latching or releasing the first attachment 3 to or from the casing 2. In the embodiment shown, a locking device is preferably provided locking into place automatically when the attachment 3 is seated on the casing 2, the locking device being, however, provided with at least one release bar 19 for unlocking as shown in FIG. 1, so that the first attachment 3 can be detached again from the casing 2.

It will be understood that attachments other than the first attachment 3 with its epilating cylinder 5 may be mounted on the casing 2, such attachments including different components, accordingly performing different functions. This requires the relevant attachment to be conformed to the casing 2 as regards its shape and the clamping or locking device. The various attachments are thus interchangeable and may be utilized in accordance with the user's desired function.

Figure 3:
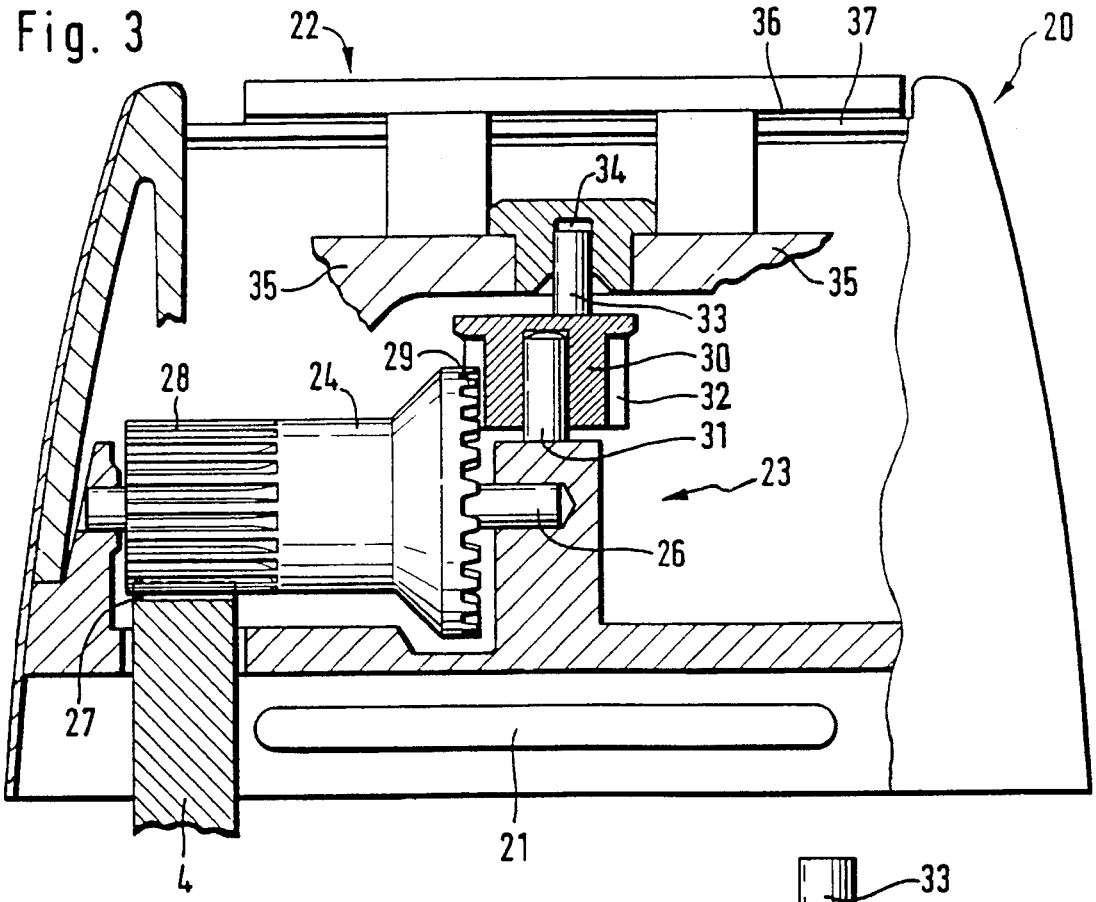
FIG. 3 is a schematic sectional view of a second attachment incorporating a long-hair trimmer for the appliance of FIG. 1.

FIG. 3 shows a second attachment 20 conformed to the casing 2 as regards its shape and the locking device preferably provided in the present embodiment. For this purpose, the second attachment 20 includes equally a release bar 21 for unlocking, thus enabling the second attachment 20 to be detached from the casing 2.

The second attachment 20 incorporates a long-hair trimmer 22 which is coupled to the driving gear 4 by means of a gear arrangement 23 enabling the trimmer to execute a linear and oscillating motion when the motor is in turned-on condition. The long-hair trimmer 22 serves to cut off body hairs on the surface of the skin.

Figure 4:
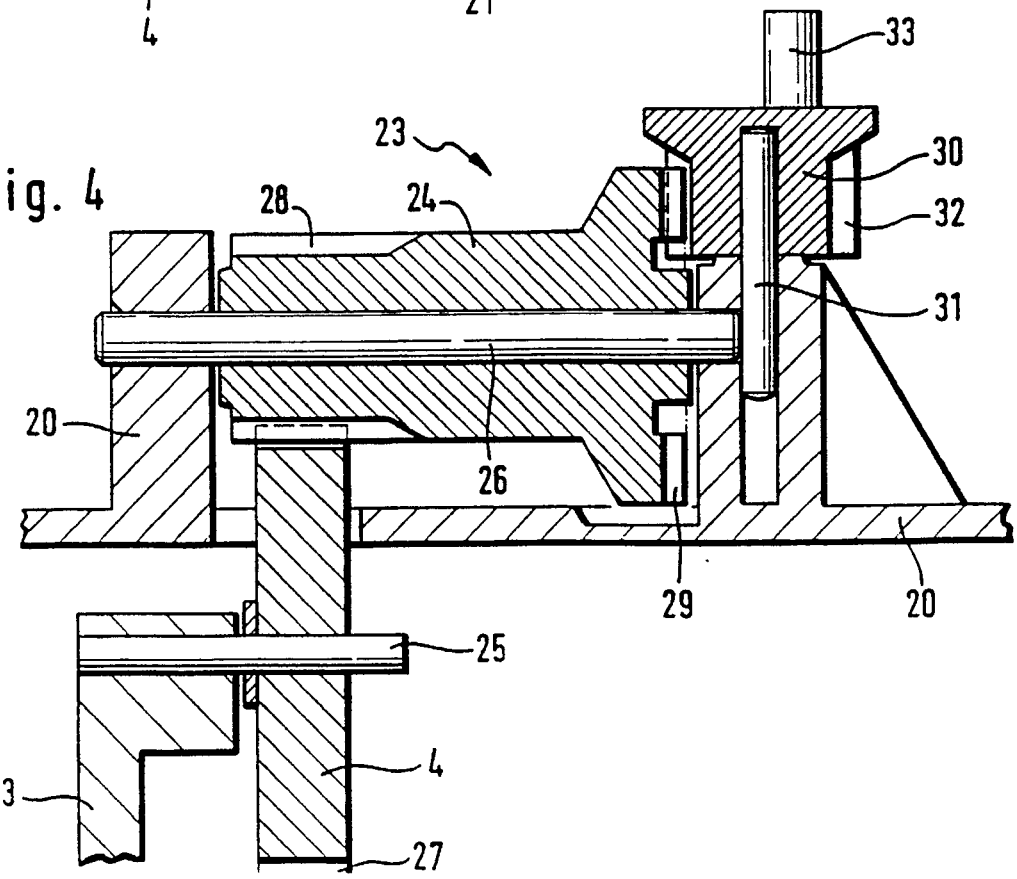
FIG. 4 is a schematic diagram depicting the gear arrangement of the long-hair trimmer of FIG. 3.

According to FIG. 4, the gear arrangement 23 includes a crown gear 24 coupled to the driving gear 4. While the driving gear 4 is mounted on a spindle 25 in the casing 2, the crown gear 24 is rotatably held in the second attachment 20 by means of a spindle 26. The driving gear 4 and the crown gear 24 have their axes in parallel arrangement. The driving gear 4 and the crown gear 24 have on their periphery operatively associated radial teeth 27, 28 which are in meshing engagement. The crown gear 24 is further provided with end teeth 29 of an annular configuration.

The gear arrangement 23 further includes a pinion 30 rotatably mounted on a spindle 31 enclosing an angle of 90 degrees with the spindle 26 of the crown gear 24. The pinion 30 has on its periphery radial teeth 32 operatively associated with the end teeth 29 and meshing therewith. Parallel to the spindle 31, an engaging means 33 disposed eccentrically to the spindle 31 extends from the pinion 30.

As becomes apparent from FIG. 3, the engaging means 33 engages within a groove 34 in a supporting structure 35 supporting a blade-like outer cutter 36. The outer cutter 36 extends across the full width of the long-hair trimmer 22 and is displaceable in this direction together with the supporting structure 35. To this end, the supporting structure 35 includes guiding means enabling the supporting structure 35 to perform a reciprocating motion together with the blade 36.

With regard to the reciprocating motion described, the groove 34 engaged by the engaging means 33 is arranged at an angle of 90 degrees such as to enable the engaging means 34 to reciprocate equally inside its groove 34.

Arranged in parallel to the outer cutter 36 is an inner cutter 37 which, like the outer cutter 36, extends across the entire width of the long-hair trimmer 22, being however fixedly held in the second attachment 20. The outer cutter 36 and the inner cutter 37 are located at the forward end of the second attachment 20 facing the skin surface when in use.

Rotation of the driving gear 4 causes rotation of the crown gear 24 and thus of the pinion 30 about its spindle 31. The eccentric arrangement of the engaging means 33 relative to the spindle 31 results in a rotation of the pinion 30 and a reciprocating motion of the supporting structure 35 together with the outer cutter 36. At the same time, the engaging means 33 reciprocates equally inside its groove 34. Thus, the engaging means 33 acts to convert the rotary motion of the pinion 30 into a linearly oscillating motion of the outer cutter 36.

Body hairs that have entered the space between the teeth of the outer cutter 36 and the teeth of the inner cutter 37 are then cut off by the linearly oscillating motion of the outer cutter 36 while the inner cutter 37 remains stationary.

It will be understood, of course, that the functions of outer cutter 36 and inner cutter 37 may be altered to the effect that the inner cutter 37 is driven to oscillate whilst the outer cutter 36 remains stationary. To ensure a highly advantageous short length of the hairs to be removed, it is essential that the outer cutter, whether oscillatory or stationary, be of an extremely thin configuration, practically a foil of a thickness in the range of 0.2 mm or less.

The appliance 1 for the removal of body hairs is preferably used as follows:

First, the second attachment 20 is mounted on the casing 2. On turning the appliance 1 on, the body hairs are then cut off on the skin surface by means of the long-hair trimmer 22. The user then waits for an individually varying period of about one week. Then the first attachment 3 is mounted on the casing 2 and the appliance 1 is turned on. The body hairs meanwhile grown back to about equal length are then firmly gripped and plucked out by the epilating cylinder 5 accommodated in the first attachment 3.

The possibility also exists to utilize the first attachment 3 with its epilating cylinder 5 and/or the second attachment 20 with its long-hair trimmer 22 independently of each other. Special applications also allow the epilation head to be used first, followed by the long-hair trimmer 22.

What is claimed is:

1. An appliance for the removal of human body hairs comprising:

a casing;

a driving gear carried in the casing and adapted to be driven by a motor;

a first attachment that attaches to, and detaches from, the casing, the first attachment configured as an epilation head and comprising an epilating cylinder mounted in the epilation head, said epilating cylinder adapted to be rotated by the driving gear for gripping and extracting the body hairs; and a second attachment that attaches to, and detaches from, the casing in exchange for the first attachment, the second attachment comprising a depilator incorporating a long-hair trimmer and a gear arrangement adapted to be driven by the driving gear, wherein said long hair trimmer includes a first cutter which is adapted to be driven by said gear arrangement to perform a reciprocating motion in alternate directions relative to a second cutter.

2. An appliance for the removal of human body hairs comprising:

a casing;

a driving gear carried in the casing and adapted to be driven by a motor;

a first attachment that attaches to, and detaches from, the casing, the first attachment configured as an epilation head and comprising an epilating cylinder mounted in the epilation head, said epilating cylinder adapted to be rotated by the driving gear for gripping and extracting the body hairs; and a second attachment that attaches to, and detaches from, the casing in exchange for the first attachment, the second attachment comprising a depilator incorporating a long-hair trimmer and a gear arrangement adapted to be driven by the driving gear, wherein said long hair trimmer includes a first cutter which is adapted to be driven by said gear arrangement to perform a reciprocating motion in alternate directions relative to a second cutter wherein during operation the first cutter oscillates at an oscillating frequency and the epilating cylinder rotates at a rotational frequency, and wherein the gear arrangement has a transmission ratio such that the oscillating frequency of the first cutter is about three to seven times the rotational frequency of the epilating cylinder.

3. An appliance for the removal of human body hairs comprising:

a casing;

a driving gear carried in the casing and adapted to be driven by a motor;

a first attachment that attaches to, and detaches from, the casing, the first attachment configured as an epilation head and comprising an epilating cylinder mounted in the epilation head, said epilating cylinder adapted to be rotated by the driving gear for gripping and extracting the body hairs; and a second attachment that attaches to, and detaches from, the casing in exchange for the first attachment, the second attachment comprising a depilator incorporating a long-hair trimmer and a gear arrangement adapted to be driven by the driving gear, wherein said long hair trimmer includes a first cutter which is adapted to be driven by said gear arrangement to perform a reciprocating motion in alternate directions relative to a second cutter wherein the gear arrangement comprises an angular gear arrangement converting the rotary motion of the driving gear into a reciprocating motion of the first cutter.

4. An appliance for the removal of human body hairs comprising:

a casing;

a driving gear carried in the casing and adapted to be driven by a motor;

a first attachment that attaches to, and detaches from, the casing, the first attachment configured as an epilation head and comprising a epilating cylinder mounted in the epilation head, said epilating cylinder adapted to be rotated by the driving gear for gripping and extracting the body hairs; and a second attachment that attaches to, and detaches from, the casing in exchange for the first attachment, the second attachment comprising a depilator incorporating a long-hair trimmer and a gear arrangement adapted to be driven by the driving gear, wherein said long hair trimmer includes a first cutter which is adapted to be driven by said gear arrangement to perform a reciprocating motion in alternate directions relative to a second cutter wherein the gear arrangement further comprises a crown gear and a pinion that includes an eccentrically arranged engaging member coupled to the first cutter, said crown gear adapted to be driven by the driving gear and meshing with said pinion.

5. An attachment as claimed in claim 1 wherein the gear arrangement comprises an angular gear arrangement converting the rotary motion of the driving gear into a reciprocating motion of the cutter.

6. An attachment as claimed in claim 5 wherein said second cutter is a stationary cutter.

7. An attachment as claimed in claim 2 wherein said second cutter is a stationary cutter.

8. An attachment as claimed in claim 3 wherein said second cutter is a stationary cutter.

9. An attachment as claimed in claim 4 wherein said second cutter is a stationary cutter.

10. An appliance as claimed in any one of the claims 6 to 9, wherein one of said first or second cutters comprises an outer cutter configured in the manner of a foil of a thickness of less than 0.2 mm.

11. An attachment as claimed in any one of the claims 6 to 8, wherein the gear arrangement further comprises a crown gear and a pinion that includes an eccentrically arranged engaging member coupled to the 1st cutter, said crown gear adapted to be driven by the driving gear and meshing with said pinion.

12. A method of using an appliance for removing human body hairs, said appliance including a motor, said method comprising:

attaching a first attachment to the appliance, said first attachment including a long hair trimmer that is operated by said motor;

using the appliance with the first attachment attached thereto to trim the body hairs;

detaching the first attachment;

with the first attachment detached, attaching a second attachment to the appliance, said second attachment including an epilator cylinder that is rotated by said motor; and using the appliance with the second attachment attached thereto to grip and pluck the body hairs.

13. The method of claim 12 wherein the step of using the appliance with the second attachment attached thereto to grip and pluck the body hairs occurs more than about a day after the step of using the appliance with the first attachment attached thereto to trim the body hairs.

14. The method of claim 13 wherein the step of using the appliance with the second attachment attached thereto to grip and pluck the body hairs occurs between 3 to 12 days after the step of using the appliance with the first attachment attached thereto to trim the body hairs.

15. An appliance for the removal of human body hairs comprising:

a casing;

a driving gear carried in the casing and adapted to be driven by a motor;

a first attachment that attaches to, and detaches from, the casing, the first attachment configured as an epilation head and comprising an epilating cylinder mounted in the epilation head, said epilating cylinder adapted to be rotated by the driving gear for gripping and extracting the body hairs; and a second attachment that attaches to, and detaches from, the casing in exchange for the first attachment, the second attachment comprising a depilator incorporating a long-hair trimmer for cutting the body hairs.

* * * * *

UNITED STATES PATENT AND TRADEMARK OFFICE

CERTIFICATE OF CORRECTION

PATENT NO. : 5,611,804

DATED : March 18, 1997

INVENTOR(S) : Hans-Eberhard Heintke, Achim Flesser

It is certified that error appears in the above-identified patent and that said Letters Patent is hereby corrected as shown below:

Col. 7, line 25, insert --first-- before "cutter".

Signed and Sealed this

Twenty-sixth Day of January, 1999

*Attest:*

*Attesting Officer*

*Acting Commissioner of Patents and Trademarks*